United States Patent [19]

Snider

[11] Patent Number: 4,461,790

[45] Date of Patent: Jul. 24, 1984

[54] SIMULATED CAKE AND COLLAPSIBLE CONTAINER THEREFOR

[76] Inventor: William Snider, 5218 Jon Paul Dr., Milford, Mich. 48042

[21] Appl. No.: 446,345

[22] Filed: Dec. 2, 1982

[51] Int. Cl.[3] ..... B65B 25/16; B65D 85/36; B65D 85/60

[52] U.S. Cl. ..... 428/7; D7/83; D11/184; 206/457; 312/204; 426/104; 428/542.8

[58] Field of Search ..... 312/204; 428/7, 8, 35, 428/542.8; D7/83; D11/184; 206/457; 426/104; 108/92, 101

[56] References Cited

U.S. PATENT DOCUMENTS 2,203,540 6/1940 Montgomery ..... 428/7 X
2,697,294 12/1954 Zenker et al. ..... 428/7 X
3,843,220 10/1974 Snider ..... 312/204
4,219,119 8/1980 Zefran ..... 428/7 X

*Primary Examiner*—Henry F. Epstein
*Attorney, Agent, or Firm*—Robert G. Mentag

[57] ABSTRACT

A simulated layer cake, including at least one layer of container structure, which includes a base plate on which is detachably mounted a cylindrical container side wall member to provide a container for holding a plurality of food items. A circular container top wall member is detachably mounted on the upper end of the cylindrical side wall container member to enclose the same. The cake layer container structure is adapted to have its outer surface coated with real decorative icing. A multiple layer cake may be formed with a plurality of the layer container structures.

9 Claims, 11 Drawing Figures

SIMULATED CAKE AND COLLAPSIBLE CONTAINER THEREFOR

TECHNICAL FIELD

This invention relates generally to the cake art, and more particularly to an improved simulated single or multiple layer cake container structure for cut and wrapped pieces of cake, donuts, candy and other food items.

BACKGROUND ART

It is known in the cake art to provide multiple layer simulated cake and container structures, as disclosed in the prior U.S. Pat. No. 3,843,220. A disadvantage of the containers disclosed in the aforementioned prior art patent is that they are of a reusable type which require costly labor to clean for reuse. The reusable containers disclosed in said prior art patent are costly to make, and require considerable space to store.

DISCLOSURE OF THE INVENTION

In accordance with the present invention, a simulated cake may be made with the containers of the present invention in the form of a single layer cake or a multiple layer cake. All of the parts of the circular hollow containers of the present invention may be made from a suitable paper material of the type employed in the packaging of bakery goods, so as to provide throw-away containers at a low cost. All of the pre-assembled flat container parts may be quickly and easily stored in a minimum of space, since they can be stored in a flat position. A single layer cake is formed by providing a flat base which is preferably circular in plan view, and releasably mounting thereon a cylindrical container wall member formed from at least one flat elongated piece of material. The top of the cylindrical container side wall is enclosed by a flat top plate or wall member, which is detachably mounted to the top end of the cylindrical wall member. A simulated multiple layer cake may be quickly and easily made by mounting a plurality of successive cylindrical wall members, and plate or wall members of decreasing diameter size, on the lowermost one of the simulated layer containers.

BEST MODE OF CARRYING OUT THE INVENTION

Figure 1:
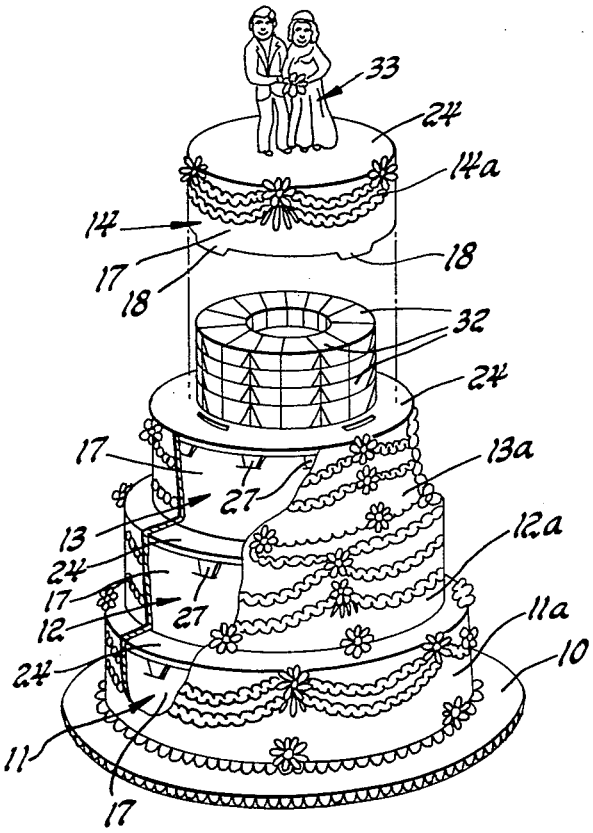
FIG. 1 is a front perspective view of a simulated multiple layer cake and container structure made in accordance with the principles of the present invention, and showing the cake in a final decorated form, and with parts of the decoration broken away.
Figure 2:
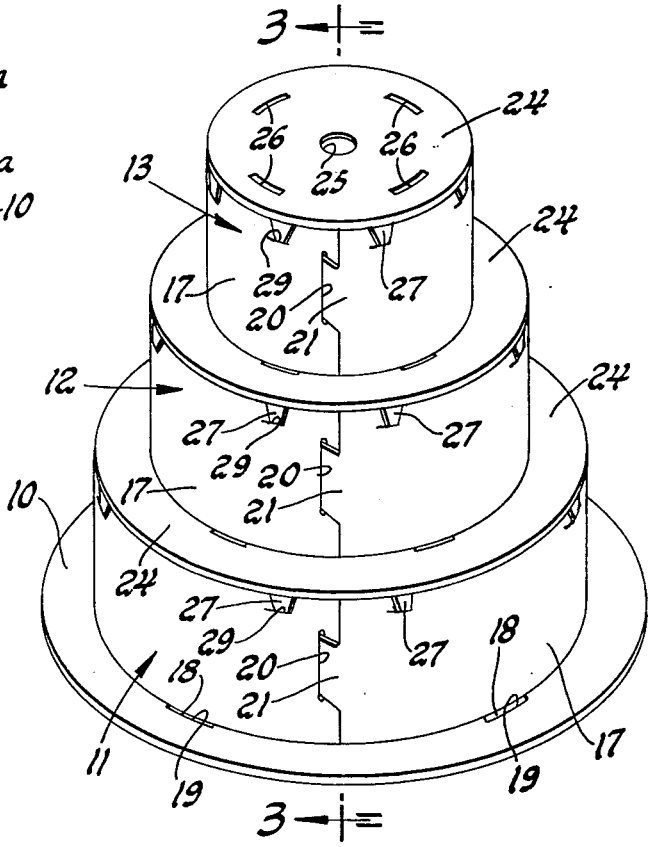
FIG. 2 is a front perspective view of the multiple layer container structure employed in the simulated multiple layer cake illustrated in FIG. 1, and showing the container structure without any frosting or icing.
Figure 3:
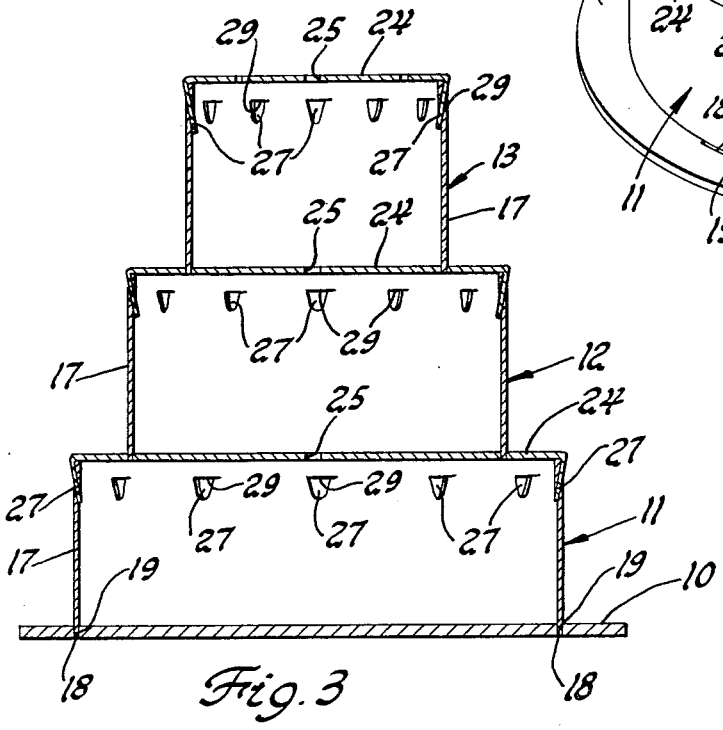
FIG. 3 is an elevation section view of the multiple layer container structure illustrated in FIG. 2, taken along the line 3—3 thereof, and looking in the direction of the arrows.
Figure 4:
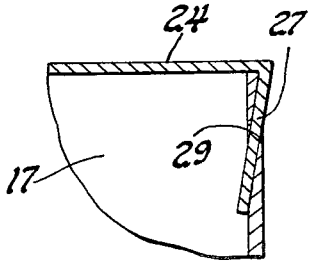
FIG. 4 is a fragmentary, elevational view of a container top end wall structure mounted on the container cylindrical wall section, and showing the interlocking tab and slot attachment structure.
Figure 6:
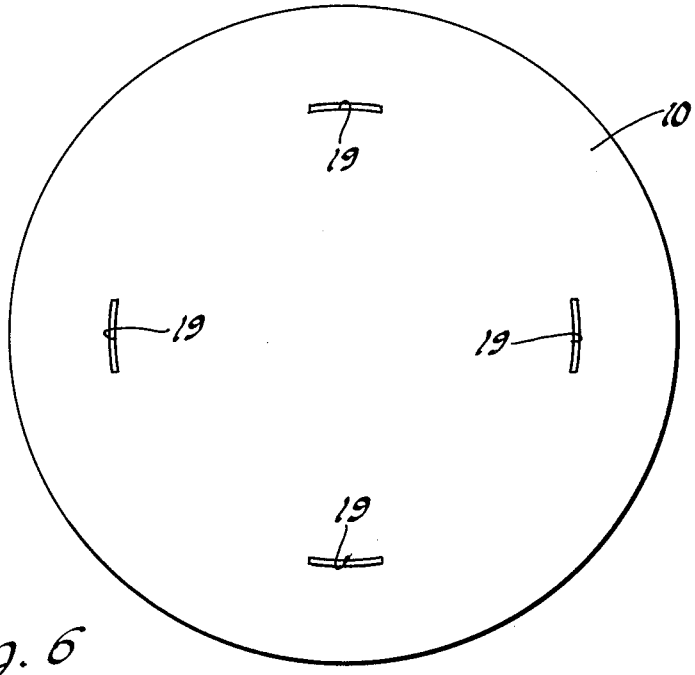
FIG. 6 is a top plan view of a base plate made in accordance with the principles of the present invention.

Referring now to the drawings, and in particular to FIGS. 1, 2 and 3, the numeral 10 generally designates a circular base plate made from a suitable material, as for example, a suitable paper cardboard material of the type employed in packaging bakery goods. The base plate 10 is circular in plan cross section, as is seen in FIG. 6.

Figure 8:
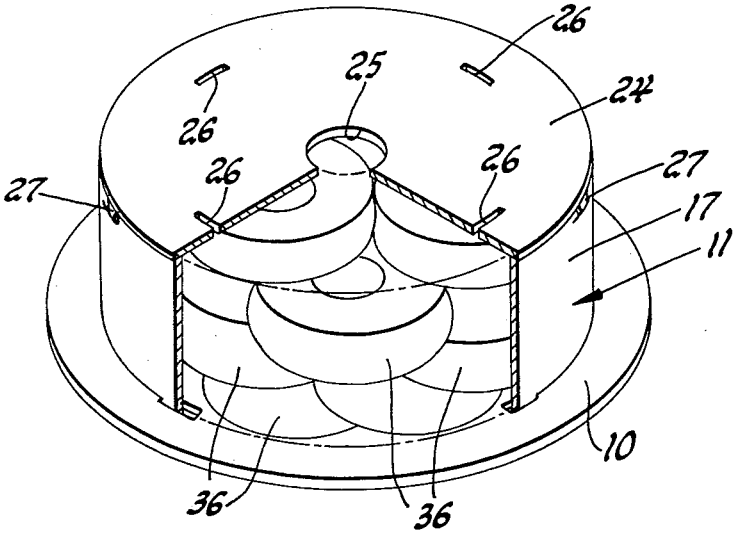
FIG. 8 is an elevational perspective view of a single layer cake container structure, with parts broken away, and showing the container without any frosting or icing thereon.

FIG. 8 shows the use of the hollow container structure of the present invention in the forming of a single layer cake. As shown in FIG. 8, the single layer cake comprises the base 10, and a single container layer, generally indicated by the numeral 11.

FIG. 1 shows the use of the circular hollow containers of the present invention in the forming of a multiple layer simulated cake, which includes a circular lower or base layer, generally indicated by the numeral 11, a second smaller diameter layer, generally indicated by the numeral 12, a third still smaller diameter layer, generally indicated by the numeral 13, and a top layer of a still smaller diameter, generally indicated by the numeral 14. The multiple layer simulated cake shown in FIG. 1 has the aforementioned multiple layers coated by a permanent or real frosting indicated by the numerals 11*a*, 12*a*, 13*a* and 14*a*.

Figure 5:
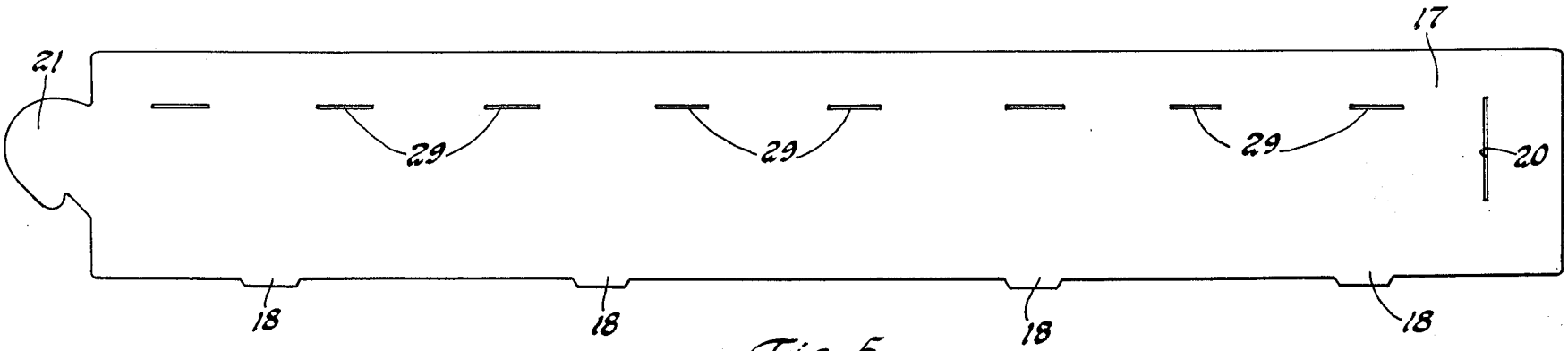
FIG. 5 is a plan view of an elongated, substantially rectangular container wall blank, showing the cylindrical container wall member in a flat, pre-assembly form, whereby it can be stored in a flat position.
Figure 7:
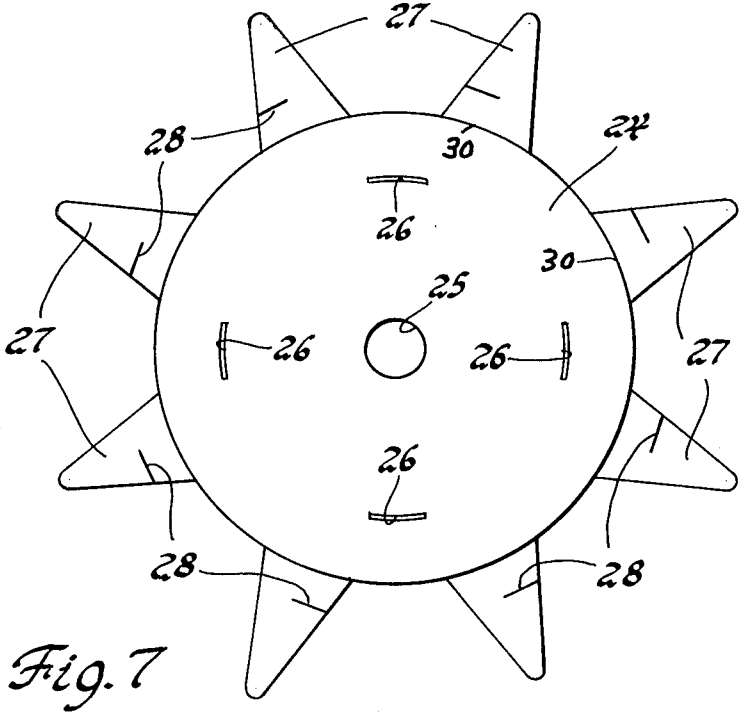
FIG. 7 is a plan view of a top end wall or plate container member showing this member in a flat, pre-assembled form, whereby it may be stored in a flat position.

Each of the simulated cake layers 11,12,13 and 14 is hollow and circular in cross section, and includes a cylindrical side wall portion 17 which is formed from an elongated, rectangular flat blank, as shown in FIG. 5. Each simulated cake layer includes a top end wall or plate having a circular central portion 24, and a plurality of integral attachment tabs 27. As shown in FIG. 7, each of the top wall or plate members 24 and their integral tabs 27 are formed from a flat paper blank, which may be easily stored in piles of the same in a small area. As shown in FIG. 6, the flat base plate 10 is also capable of being stored in stacks of the same in a small area before a simulated cake layer is formed from the layer parts 10, 17 and 24.

In forming the lowermost or base container illustrated in FIG. 8, the base plate 10 is positioned on a tube suitable supporting table surface or the like, and a container side wall member 17 is then formed in a circle and the attachment tab 21 on one end thereof is inserted through attachment slot 20 on the other end thereof, to form a circular cylindrical hollow wall member 17. As shown in FIG. 5, each of the vertical side wall blanks has plurality of longitudinally spaced apart, downwardly extended, integral attachment prongs or legs 18 which are adapted to be seated in mating arcuate slots 19, formed in the base plate 10. As shown in FIG. 6, the slots 19 are equally spaced apart from each other in a circular arrangement.

The next step in forming a single layer simulated cake structure of the type shown in FIG. 8 comprises the mounting of the top wall or plate 24 on the vertical side wall. The top wall blank 24 is shown in FIG. 7, and the first step would be to bend the attachment tabs 27 downwardly along the bend lines 30 on the top wall plate 24. Each of the tabs 27 is provided with a transverse slot 28 which is in the horizontal position when it is mounted on a vertical side wall member 17. The tabs 27 are mounted through an equal number of horizontal slots 29, which are formed through the cylindrical side wall member 17 in peripherally spaced apart positions. The top wall or cover member 24 is pressed downwardly to insert the tabs 27 in the slots 29, after which the top wall member 24 is rotated in a counterclockwise directions, as view in FIG. 7, so as to move each slot 28 over the adjacent edge of its respective slot 29 and onto the solid material of the vertical side wall member 17, to securely connect the top wall member 24 on the cylindrical side wall member 17.

As shown in FIGS. 7 and 8, the top wall container member 24 is provided with a central hole 25 which functions as a finger hole for the person assembling or disassembling the container members, to handle the same in a quick and easy assembly manner.

It will be understood that the top wall member 24 may be quickly and easily assembled onto the cylindrical side wall member 17, before the side wall member 17 of the lower container layer 11 is mounted on the base plate 10, so that food items such as donuts, indicated by the numeral 36, may be stacked on the base plate 10 within the circle formed by the attachment slots 19. The lower layer container 11 may then be mounted over the donuts 36, with the prongs 18 extended into the slots 19. It will also be understood that the lower container side wall member 17 of the lower layer 11 may be first mounted on the base 10, and the donuts 36 stacked therein, before the top wall portion 24 is mounted on the wall portion 17 with its pointed tabs 27 in the slots 29. Another method of loading food items in the container member would be to put the top wall portion 24 on the side wall member 17 and the assembly upside down and load the food items, and then applying the base plate 10. Each succeeding layer in the multiple layer structure of the type shown in FIGS. 1, 2 and 3 may be similarly loaded with food items. The numeral 33 in FIG. 1 shows the uppermost simulated cake layer 14 loaded with cut and wrapped pieces of cake 32.

Figure 9:
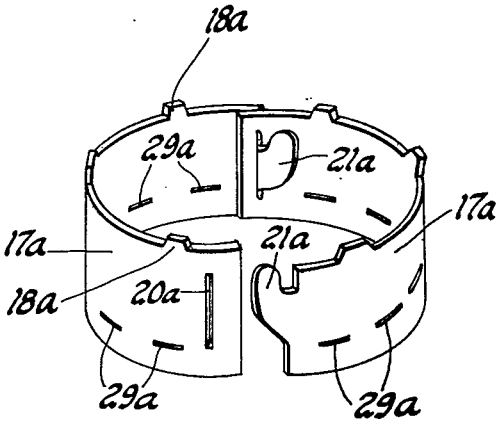
FIG. 9 is a modification of the invention, showing the forming of a large diameter cylindrical cake container structure formed by the use of two container wall blanks.
Figure 10:
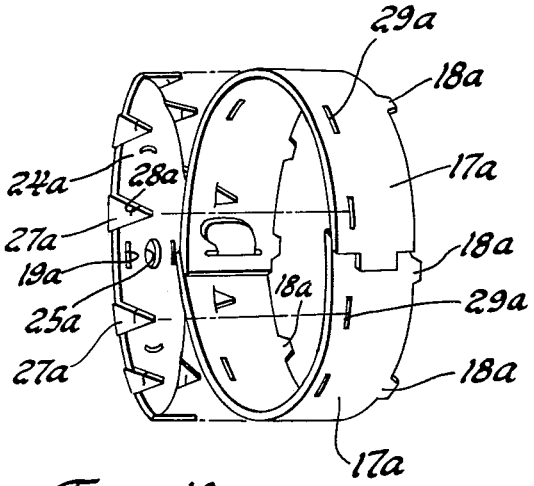
FIG. 10 shows a large top end wall or plate member, in a position partially assembled on the top end of a container cylindrical wall member, made in accordance with the container wall structure shown in FIG. 9.
Figure 11:
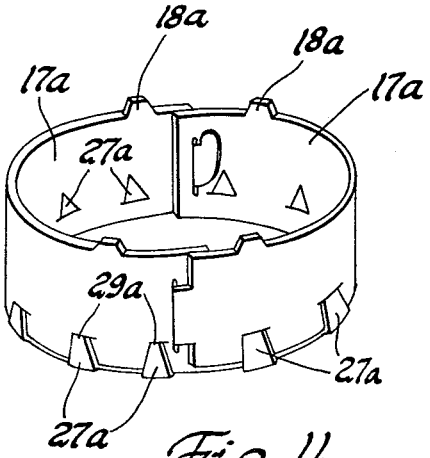
FIG. 11 illustrates the complete assembly of the top end wall structure shown in FIG. 10 on the wall member of FIG. 9.

FIGS. 9, 10 and 11 show the forming of a larger diameter cake employing two flat blanks 17*a*, and a larger diameter top wall blank 24*a*. The parts of the simulated cake layer structure illustrated in FIGS. 9, 10 and 11 have been marked with the same reference numerals as used in the description of the smaller diameter containers of FIGS. 1 through 8, followed by the small letter "a". As shown in FIG. 9, the vertical side wall of a larger diameter container would be formed by assembling two of the flat wall blanks 17*a*, in the manner illustrated in FIG. 9, and the top wall member 24*a* then assembled as illustrated in FIGS. 10 and 11. The larger diameter simulated cake layer container structure of FIGS. 9 through 11 would obviously be mounted on a larger diameter base 10.

INDUSTRIAL APPLICABILITY

The simulated cake layer container structure of the present invention is adapted for use in the bakery art in applications where it is desired to provide a simulated cake of one layer or a plurality of layers, and wherein each of the simulated cake layers is adapted to hold a plurality of food items, such as cut and wrapped pieces of cake, candy, donuts, and the like.

I claim:

1. A simulated layer cake, including at least one layer container structure, comprising:

(a) a base plate;

(b) a cylindrical container side wall member;

(c) means for detachably mounting the wall member on said base plate, to form a container for holding a plurality of food items;

(d) a circular, container top wall member detachably mounted on the upper end of the cylindrical container side wall member to enclose the same; and, (e) said layer container structure having the outer surface coated with real decorative icing.

2. A simulated layer cake as defined in claim 1, wherein:

(a) said base plate is a circular plate made from a cardboard material.

3. A simulated layer cake as defined in claim 1, wherein:

(a) said cylindrical container side wall member is formed from an elongated, substantially rectangular flat paper blank which is formed into a circle, and with the ends detachably connected together before it is mounted on the base plate.

4. A simulated layer cake as defined in claim 3, wherein:

said container circular top wall member is made from a flat paper blank having a central flat circular top wall portion that is seated on the upper end of the container cylindrical wall member, and means for detachably mounting the top wall member on the cylindrical wall member.

5. A simulated layer cake as defined in claim 4, wherein:

(a) said means for detachably mounting the wall member on the base member includes a plurality of slots formed through the base plate in a spaced apart circular disposition, and a plurality of prongs extended downwardly from the lower edge of the cylindrical side wall member for sliding engagement of the same in said slots in the base plate.

6. A simulated layer cake as defined in claim 5, wherein:

(a) said means for detachably mounting the top wall member on the cylindrical side wall member includes a plurality of equally spaced apart slots formed through the upper end of the cylindrical side wall member, and a plurality of pointed tabs integrally mounted around the periphery of the central flat circular top wall member and being bent downwardly toward the cylindrical side wall member and slidably engagable with the plurality of slots in the cylindrical side wall member.

7. A simulated layer cake as defined in claim 6, wherein:

(a) each of said pointed tabs is provided with a transverse slot whereby the circular top wall member may be rotated relative to the circular side wall member to receive the adjacent portion of the circular side wall member into each of the transverse slots on the pointed tabs.

8. A simulated layer cake as defined in claim 7, wherein:

(a) said layer cake includes a plurality of said cylindrical container layer structures, similarly shaped, and arranged in superposed relation to each other and decreasing in diametrical size from the uppermost one to the lowermost one of said cylindrical container layer structures, and with the container circular top wall member of each cylindrical container layer structure forming the base plate for the cylindrical container layer structure immediately disposed above.

9. A simulated layer cake as defined in claim 1, wherein:

(a) said cylindrical container side wall member is formed from a plurality of elongated, substantially rectangular flat paper blanks which are formed into a circle, and with the ends of each blank being detachably connected to the adjacent end of the adjacent paper blank before the cylindrical container sidewall member is mounted on the container base plate.

* * * * *